US011473291B2

(12) United States Patent
Banerjee et al.

(10) Patent No.: US 11,473,291 B2
(45) Date of Patent: Oct. 18, 2022

(54) EXPANDABLE FIELD KITCHEN

(71) Applicant: NEXGEN COMPOSITES LLC, Franklin, OH (US)

(72) Inventors: Robin Banerjee, Centerville, OH (US); Michael S. Sheppard, Centerville, OH (US); Robert LaPoint, Charleston, SC (US)

(73) Assignee: NEXGEN COMPOSITES LLC, Franklin, OH (US)

( * ) Notice: Subject to any disclaimer, the term of this patent is extended or adjusted under 35 U.S.C. 154(b) by 0 days.

(21) Appl. No.: 17/120,544

(22) Filed: Dec. 14, 2020

(65) Prior Publication Data

US 2021/0180314 A1 Jun. 17, 2021

Related U.S. Application Data

(60) Provisional application No. 62/947,164, filed on Dec. 12, 2019.

(51) Int. Cl.
*E04B 1/343* (2006.01)
*E04H 1/12* (2006.01)

(52) U.S. Cl.
CPC ..... *E04B 1/34357* (2013.01); *E04B 1/34336* (2013.01); *E04H 1/1205* (2013.01)

(58) Field of Classification Search
CPC ..... E04H 1/1205; E04B 1/34357; E04B 1/34336
USPC ..... 52/79.5
See application file for complete search history.

(56) References Cited

U.S. PATENT DOCUMENTS 3,809,278 A * 5/1974 Csumrik ..... B65D 7/30 220/4.33
4,077,568 A * 3/1978 May ..... F24H 9/02 237/8 D
4,599,829 A * 7/1986 DiMartino, Sr. ..... E04B 1/3483 410/79
5,265,385 A * 11/1993 Smith ..... B65D 85/68 52/143
6,070,372 A * 6/2000 Norman ..... E04B 1/3444 52/36.2
6,823,639 B2 * 11/2004 Hampel ..... E04H 1/1216 52/506.01
7,418,802 B2 * 9/2008 Sarine ..... E04B 1/34305 52/79.1

(Continued)

FOREIGN PATENT DOCUMENTS

BE 1024921 B1 * 8/2018 ..... B60P 3/025
WO WO-9005222 A1 * 5/1990 ..... E04B 1/3445
WO WO-2018146185 A1 * 8/2018 ..... E04B 1/3483

*Primary Examiner* — Brian D Mattei
*Assistant Examiner* — Joseph J. Sadlon
(74) *Attorney, Agent, or Firm* — Thomas E. Lees, LLC

(57) ABSTRACT

According to aspects of the present disclosure, an expandable field kitchen is disclosed. The expandable field kitchen includes an expandable intermodal container. The expandable intermodal container has a floor panel, a ceiling panel, a wall panel including an opening, an access door disposed on the wall panel, an appliance utility port disposed on an interior surface of the expandable intermodal container, and a service door having a low-profile door handle. The addition, the expandable intermodal container includes an expansion unit that deploys from the interior portion of the expandable intermodal container through the opening.

20 Claims, 9 Drawing Sheets

(56) References Cited

U.S. PATENT DOCUMENTS 7,874,107 B1 * 1/2011 Medley ..... E04B 1/3444 52/79.5
7,966,775 B2 * 6/2011 Medley ..... E04B 1/3444 52/79.5
8,281,529 B2 * 10/2012 Cluff ..... E04C 3/14 52/592.2
8,544,216 B1 * 10/2013 Hazlett ..... E04H 1/1205 52/79.5
8,555,559 B2 * 10/2013 DiGregory ..... E04B 1/3445 52/79.5
8,622,066 B2 * 1/2014 Dolsby ..... E04H 15/008 135/143
8,720,126 B2 * 5/2014 Strickland ..... E04B 1/3442 52/79.5
8,733,813 B2 * 5/2014 Blackwell ..... A61G 3/001 296/24.38
8,770,422 B2 * 7/2014 Cantin ..... B65D 19/44 220/23.83
9,068,352 B2 * 6/2015 Thompson ..... E04B 1/34
9,801,783 B2 * 10/2017 Perovi ..... A61H 33/066
9,957,708 B2 * 5/2018 Brewer ..... H02K 7/1807
10,370,847 B2 * 8/2019 Caffaratti Giro ..... E04H 15/008 52/79.1
10,655,889 B2 * 5/2020 Tully ..... F24F 13/32
10,808,896 B2 * 10/2020 Casement ..... F21S 8/063
10,985,689 B2 * 4/2021 Wickramasekera ..... E04B 1/34336
2005/0108957 A1 * 5/2005 Quesada ..... E04H 1/1266 52/143
2006/0254159 A1 * 11/2006 Trautman ..... E04B 1/3444 52/64
2010/0147842 A1 * 6/2010 Reynard ..... B65D 90/22 220/23.88
2010/0269419 A1 * 10/2010 Gyory ..... E04B 1/34384 52/79.5
2010/0325989 A1 * 12/2010 Leahy ..... E04B 1/34321 52/270
2012/0006369 A1 * 1/2012 Cantin ..... E04B 1/3444 135/96
2012/0311938 A1 * 12/2012 Larson ..... E04B 1/3444 52/79.5
2013/0263527 A1 * 10/2013 Barrett ..... E04H 15/008 52/79.1
2014/0033619 A1 * 2/2014 Merchant ..... E04B 1/3442 52/71
2016/0319534 A1 * 11/2016 Bernardo ..... E04B 1/2403
2017/0051497 A1 * 2/2017 Kolbe ..... E04H 1/1205
2019/0128478 A1 5/2019 Banerjee et al.
2020/0251803 A1 * 8/2020 Dominguez ..... E04B 1/3483

* cited by examiner

EXPANDABLE FIELD KITCHEN

CROSS REFERENCE TO RELATED APPLICATIONS

This application claims the benefit of U.S. Provisional Patent Application Ser. No. 62/947,164, filed Dec. 12, 2019, entitled "EXPANDABLE FIELD KITCHEN", the disclosure of which is hereby incorporated by reference.

BACKGROUND

Various aspects of the present disclosure relate to expandable containers, and more specifically to an expandable field kitchen.

A container is a tool that creates a partially or fully enclosed space. In this regard, containers may be used to contain, hold, or otherwise store items. Moreover, containers can be configured to accommodate specialized needs. For example, containers can be configured to serve as mobile refrigeration units.

BRIEF SUMMARY

According to aspects of the present disclosure, an expandable field kitchen is disclosed. The expandable field kitchen includes an expandable intermodal container. The expandable intermodal container has a floor panel, a ceiling panel, a wall panel including an opening, an access door disposed on the wall panel, an appliance utility port disposed on an interior surface of the expandable intermodal container, and a service door having a low-profile door handle. In addition, the expandable intermodal container includes an expansion unit that deploys from the interior portion of the expandable intermodal container through the opening.

According to further aspects of the present disclosure, the expandable field kitchen may further include a recessed ceiling cavity with an electrical control panel disposed in the recessed ceiling cavity and a floor panel comprising a recessed grease (or other waste) trap under a portion the floor panel.

In several embodiments, the expandable field kitchen also includes an expansion unit. The expansion unit has an expansion floor panel, an expansion ceiling panel that opposes the expansion floor panel, an expansion front panel that couples to the expansion floor panel and the expansion ceiling panel, a first expansion side panel disposed orthogonally to the expansion floor panel and the expansion ceiling panel, and a second expansion side panel that opposes the first expansion side panel.

In various embodiments, the expansion unit also includes a service door having a low-profile door handle disposed on the first expansion side panel, the second expansion side panel, the expansion front panel, or a combination thereof.

In many embodiments, the expandable field kitchen further includes additional expansion units (a second expansion unit, a third expansion unit, etc.), each with their own expansion panels including services doors and/or serving windows as described in greater detail herein.

DETAILED DESCRIPTION

Figure 1:
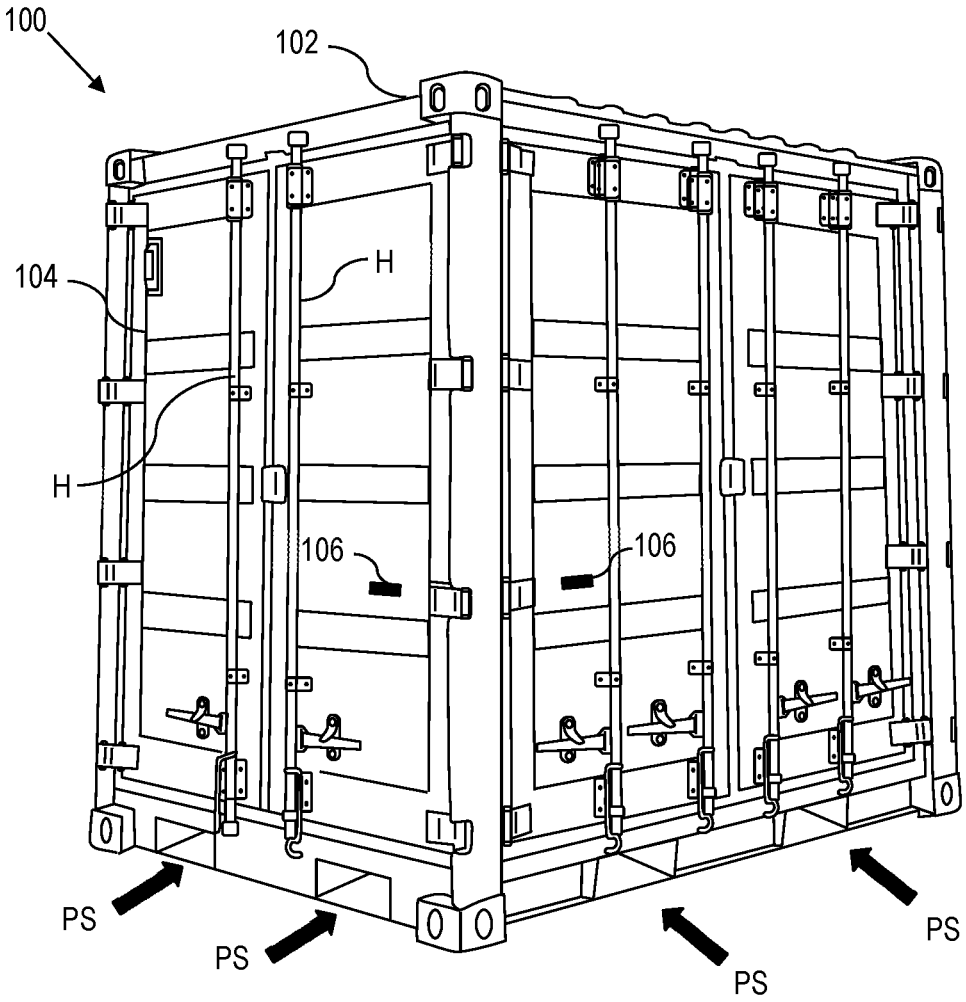
FIG. 1 is perspective view of an embodiment of an expandable intermodal container according to aspects of the present disclosure.

Various aspects of the present disclosure are directed toward expandable containers, and more specifically to an expandable field kitchen. With respect to containers in general, a container can be a permanently assembled structure, or the container can be readily assembled/disassembled. For instance, a container can be disassembled into component parts for ease of transportation and then deployed in the field (e.g., at a suitable location) back into a container.

In this regard, the assembled container can function as a storage unit, as a housing unit, shelter, or for any other reasonable purpose. In some embodiments, the container can be assembled such that all necessary parts are integrated into the container panels or are otherwise incorporated therewith, which reduces or eliminates a risk for losing parts necessary to assemble or deploy the container.

Modern intermodal shipping containers are capable of being transported by various modes including land, rail, sea and air and come in various standard sizes as specified by International Standards Organization specifications such as ISO 668. The standardization of shipping container dimensions and other characteristics allow efficient handling, storage, transportation and logistical operations across the globe and contributes to the growth of global trade.

By way of illustration, some shipping containers in commercial service are 8 ft (feet) wide, 40 ft long and 8 ft 6 inches high (or ~2.43 m (meters) wide, ~12.20 m long, and ~2.60 m high) and 8 ft wide, 20 ft long and 8 ft 6 inches high (or ~2.43 m wide, ~6.10 m long, and ~2.60 m high). In some instances, the shipping containers can be 9 ft 6 inches (~2.90 m) high.

Another standard size that is often used by the U.S. military includes 8 ft wide, 10 ft long and 8 ft high (or ~2.43 m wide, ~12.20 m long, and ~2.60 m high), which may be referred to as a "Bicon". Containers that are 8 ft wide, 6 ft 6 inches long and 8 ft high (or ~2.43 m wide, ~2.00 m long, and ~2.43 m high) are generally referred to as "Tricon", and 8 ft wide, 4 ft 10 inches long and 6 ft 10 inches (or ~2.43 m wide, ~1.47 m long, and ~2.09 m high) for a "Quadcon".

Two Bicons can be connected with special connectors at the top and bottom corners to form a 20 ft long container.

Similarly, three Tricons and four Quadcons can be connected to form a 20 ft long container. Thus, the Bicons, Tricons and Quadcons, when connected as 20 ft units, can be stored, handled and transported efficiently.

Conversely, an expandable container has a main structure similar to the standard ISO container but also contains hinged wall, roof and floor panels that can be extended from one, two, three or four walls of the container to significantly increase the footprint and interior space. For example, an expandable Tricon has the footprint of a single Tricon when collapsed and can be expanded to have two, three, or four times larger footprint depending on the number of expansion sections. Moreover, other sizes and variations of standard sizes of containers (e.g., as described in International Organization for Standardization (ISO) 1496 standard, 1A, 1AA, 1AAA, 1C, 1CC, 1CX, 1D, etc.) are applicable to aspects of the present disclosures as described in greater detail herein.

There are multiple advantages attributable to expandable containers. For instance, the ability to compact multiple container's worth of volume into a reduced footprint (e.g., the size of a single container) makes the expandable container more efficient for travel when compared to traditional containers, especially over water, air, rough terrain, etc., where cargo space is a luxury for water vessels, aircraft, and land transportation vehicles.

Further, the ability to collapse an expandable container back into a compact footprint, move the collapsed expandable container to another location, and re-deploy the expandable container to its expanded form may allow mobile users (e.g., militaries, first responders, etc.) to more efficiently transport the expandable container along with a base camp or forward operating base as needed. During a deployment or tour, the base camp or forward operating base may be required to relocate multiple times. Having a container that can collapse, transport, and deploy can reduce the man hours spent on the relocation process.

While expandable containers are generally flexible in terms of how they are used, specialized tasks and needs can render generic containers less optimal or infeasible altogether. For instance, while a non-specialized expandable container can be reasonably adapted to become a kitchen unit by addition of a heating, ventilation, and air conditioning (HVAC) unit, specialized tasks such as preparing and cooking a wide array of food items necessitate consideration of factors such as air ventilation, managing food byproducts (e.g., grease fumes, liquid grease), managing electrical power, plumbing, and more. Accordingly, aspects of the present disclosure are directed toward addressing the above considerations and more as described in greater detail herein.

Expandable Field Kitchen

Now referring to FIG. 1, an expandable field kitchen 100 is disclosed. The expandable field kitchen 100 comprises an expandable intermodal container 102 and an access door 104 (e.g., disposed on a wall panel including an opening) that provides access to an interior portion of the expandable intermodal container 102. The access door 104 can be secured using various locks, latches, and fasteners such as vertical cross bars as shown in FIG. 1. In multiple embodiments, the access door 104 is an outward-articulating double-door.

In various embodiments, handles ("H") for the access door 104 will be placed or sized such that the handles stay within an exterior vertical plane of a door frame and also within an allowable dimensional envelope to meet ISO specifications (e.g., the handles (H) do not extend beyond (or protrude) beyond dimensions of the expandable intermodal container 102).

One advantage of the outward-articulating double-door is even weight distribution across the expandable intermodal container 102, as opposed to a single door or panel, which may introduce excess stresses and/or loads to the expandable intermodal container 102 (e.g., at hinge points) when the single door is open.

In various embodiments, the access door 104 further comprises level gauges 106 that allow users of the expandable intermodal container 102 to quickly assess if the expandable intermodal container 102 is level (or at least on a level surface). In addition, multiple configurations of the expandable intermodal container 102 comprise pallet slots ("PS", indicated by solid black arrows) that enable a materials handling vehicle (e.g., a forklift) to transport the expandable intermodal container 102.

Figure 2A:
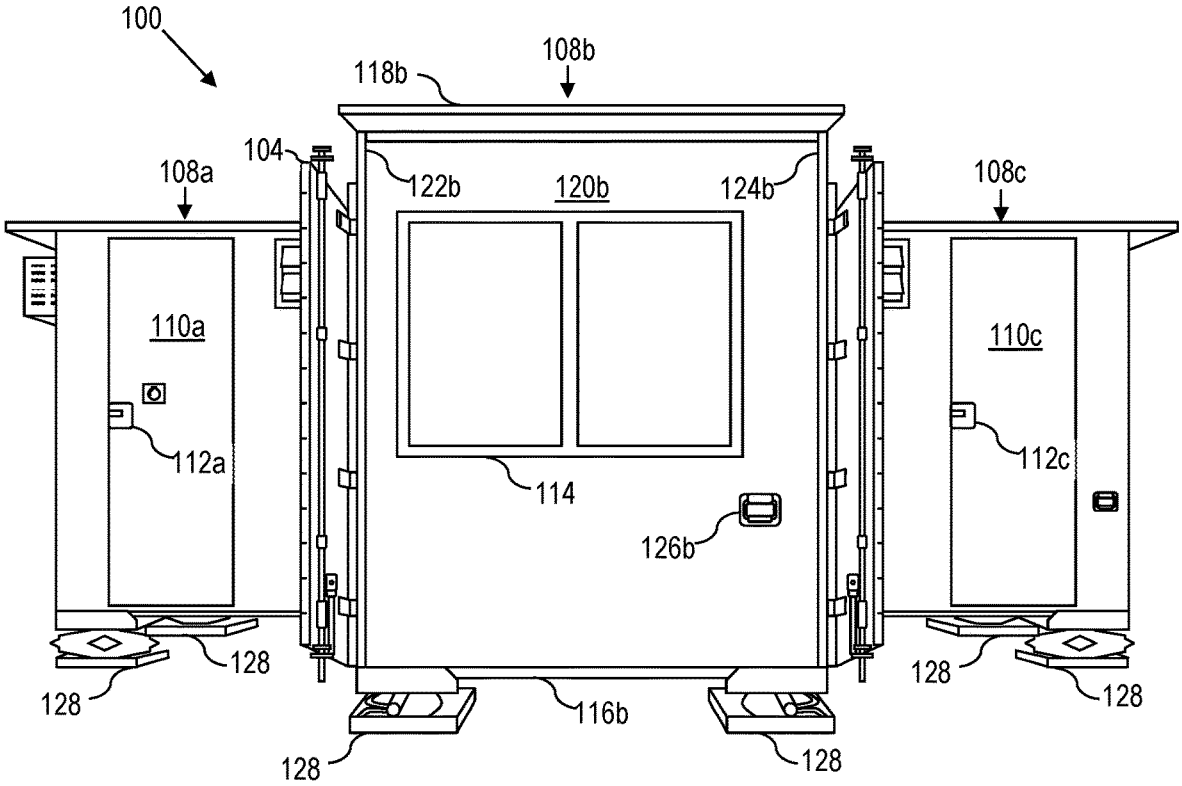
FIG. 2A is front view of an embodiment of the expandable field kitchen with three deployed expansion units according to aspects if the present disclosure.
Figure 2B:
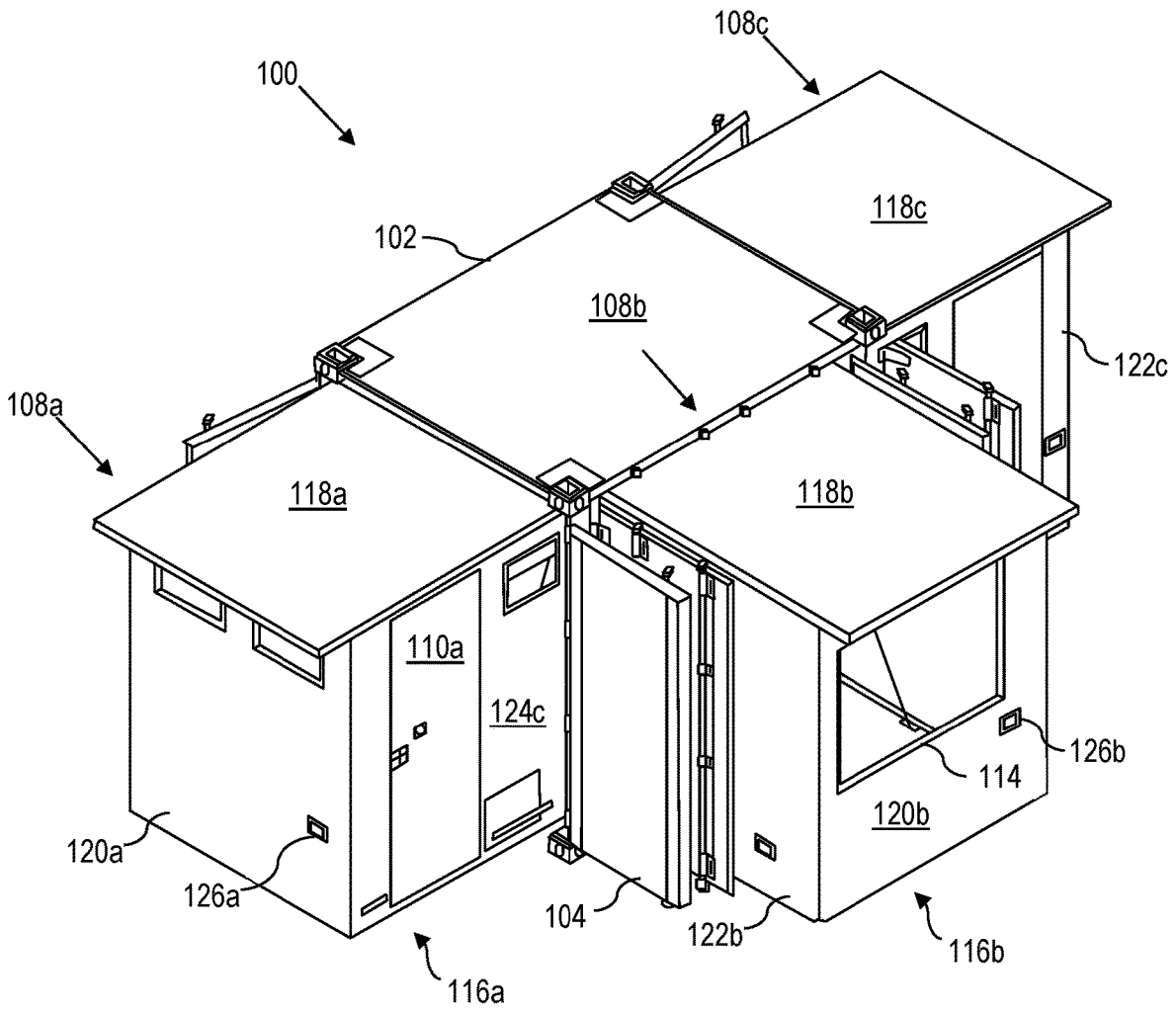
FIG. 2B is a perspective view of the embodiment of the expandable field kitchen of FIG. 2A according to aspects if the present disclosure.

FIGS. 2A-2B generally illustrate a Tricon embodiment of the expandable intermodal container 102 that comprises three expansion units labeled 108*a*, 108*b*, and 108*c* from left to right based the front view of FIG. 2A. Here, expansion units 108*a* and 108*c* are illustrated with a service door 110 (i.e., 110*a* and 110*c* respectively) with a low-profile door handle 112 (112*a* and 112*c* respectively), and expansion unit 108*b* is illustrated with a serving window 114.

In various embodiments, the low-profile door handle will be flush or recessed into a panel so as to allow easy folding and stowage. The specially designed door handle incorporates a secure locking mechanism to prevent unauthorized entry and spring-loaded handle. The entire handle is contained within the thickness of the door so the handle does not rub against other components of the expandable kitchen when stowed. In many embodiments, the thickness of the door is approximately 2.5 centimeters. The low-profile door handle is described in greater detail in reference to FIGS. 7-8 below.

Features such as the service door 110 and the serving window 114 can be used interchangeably (or combined) amongst the expansion units (108*a*-108*c*). Moreover, while FIGS. 2A-2B illustrate an embodiment with three expansion units (108*a*-108*c*), various embodiments of the expandable intermodal container 102 may only utilize one or two expansion units.

For clarity and conciseness, features and embodiments associated with the term "expansion unit" (e.g., 108*a*), while used in singular form in some contexts, are applicable to one or more expansion units in embodiments where more than one expansion unit is utilized.

Structurally, an expansion unit 108 (e.g., 108*a*) comprises an expansion floor panel 116, an expansion ceiling panel 118 that opposes the expansion floor panel 116, an expansion front panel 120 that couples to the expansion floor panel 116 and the expansion ceiling panel 118, a first expansion side panel 122 disposed orthogonally to the expansion floor panel 116 and the expansion ceiling panel 118, and a second expansion side panel 124 that opposes the first expansion side panel 122.

For a second expansion unit (e.g., 108*b*), the second expansion unit comprises a second expansion floor panel (analogous to the first expansion floor panel 116), a second expansion ceiling panel (analogous to the first expansion ceiling panel 118) that opposes the second expansion floor panel, a second expansion front panel (analogous to the first expansion front panel 120) that couples to the second expansion floor panel and the second expansion ceiling panel, a third expansion side panel (analogous to the first expansion side panel 122) disposed orthogonally to the second expansion floor panel and the second expansion ceiling panel, and a fourth expansion side panel (analogous to the second expansion floor panel 124) that opposes the third expansion side panel.

For a third expansion unit (e.g., expansion unit 108*c*), the third expansion unit comprises a third expansion floor panel (analogous to the first expansion floor panel 116), a third expansion ceiling panel (analogous to the first expansion ceiling panel 118) that opposes the third expansion floor panel, a third expansion front panel (analogous to the first expansion front panel 120) that couples to the third expansion floor panel and the third expansion ceiling panel, a third expansion side panel (analogous to the first expansion side panel 122) disposed orthogonally to the third expansion floor panel and the third expansion ceiling panel, and a fourth expansion side panel (analogous to the second expansion floor panel 124) that opposes the third expansion side panel.

Addition of a third expansion section specifically dedicated to the serving of the prepared food allows this function to be physically removed from the cooking/preparation areas and the cleaning areas allowing multiple functions to be performed at the same time. Three or more food service personnel can operate in the kitchen simultaneously without interfering with each other's work.

For each expansion unit 108, orientation of the expansion panels is based on which side of the expandable intermodal container 102 the expansion panels are deployed from. For example, the front panel 120*b* of expansion unit 108*b* is on the same panel as the service window. Conversely, the front panel 120*a* of expansion unit 108*a* is not on the same panel as the service door 110*a*.

The above example is for illustration purposes only. In various embodiments, the service door 110*a* of expansion panel 108*a* could be on the front panel 120*a*. The same applies for the various features (e.g., service door, service window, ports, etc.) described herein.

For clarity, while service doors (e.g., the service door 110*a*) are disclosed in conjunction with expansion units, service doors can also be integrated into expandable intermodal containers instead of (or in conjunction with) expansion units.

In various embodiments, the expansion ceiling panel 118 (or a portion thereof) extends beyond the expansion front panel 120 in at least one dimension to allow for rain runoff. Such a configuration is also useful for providing cover to users and patrons at the serving window 114 (e.g., for food services).

Further, each expansion panel (e.g., the expansion floor panel 116, the expansion ceiling panel 118, the expansion front panel 120, the first expansion side panel 122, the second expansion side panel 124, or a combination thereof) may be comprised of vacuum insulated panels (VIP(s)). A VIP is a panel having a form of thermal insulation comprising a gas-tight enclosure surrounding a rigid core (e.g., fumed porous silica or glass fiber), from which the air has been evacuated. VIPs generally provide higher insulation performance when compared to conventional insulation materials.

The various expansion panels herein can also include blown foam or other forms of insulation. External surfaces or "skins" of the various panels herein can be comprised of a composite skin (e.g., fiberglass, polymers, etc.), metal skins (e.g., metal skins such as zinc, copper, stainless steel, titanium, aluminum, metal composite materials, or combinations thereof), or combinations thereof.

Further examples of how the expansion unit 108 can be deployed/assembled, as well as VIP configurations (e.g., sandwich panel configurations), are disclosed in application Ser. No. 16/172,242 "CONTAINER PANEL AND STRUCTURES USING CONTAINER PANELS", which is hereby incorporated by reference.

Moreover, various tools can be used to aid in deploying the expansion panels. For instance, a pogo stick or similar implement can be used to prop up the expansion ceiling panel 118, which allows a user to deploy the other expansion panels without having to personally hold the expansion ceiling panel 118 up.

In various embodiments, one or more expansion units 108 may further comprises one or more handles 126 to aid in deployment of the expansion unit 108 (e.g., pull handles). In preferred embodiments, the handles 126 are flush to, or recessed within, panels of the expansion unit 108 (e.g., the expansion front panel 120 as shown in FIG. 2) as to allow more compact storage of the expansion unit 108 when it is stowed in the expandable intermodal container 102.

In multiple implementations, the expandable field kitchen 100 further comprises vertically adjustable support jacks 128 that support a portion of the expansion floor panel 116. Since various embodiments of the expandable field kitchen 100 are mobile by design and function, it is possible that the expandable field kitchen 100 may be placed in an area where a ground surface is not adequately level. The vertically adjustable support jacks 128 can offset the unlevel ground, thereby creating a level environment for the expandable field kitchen 100.

Figure 3:
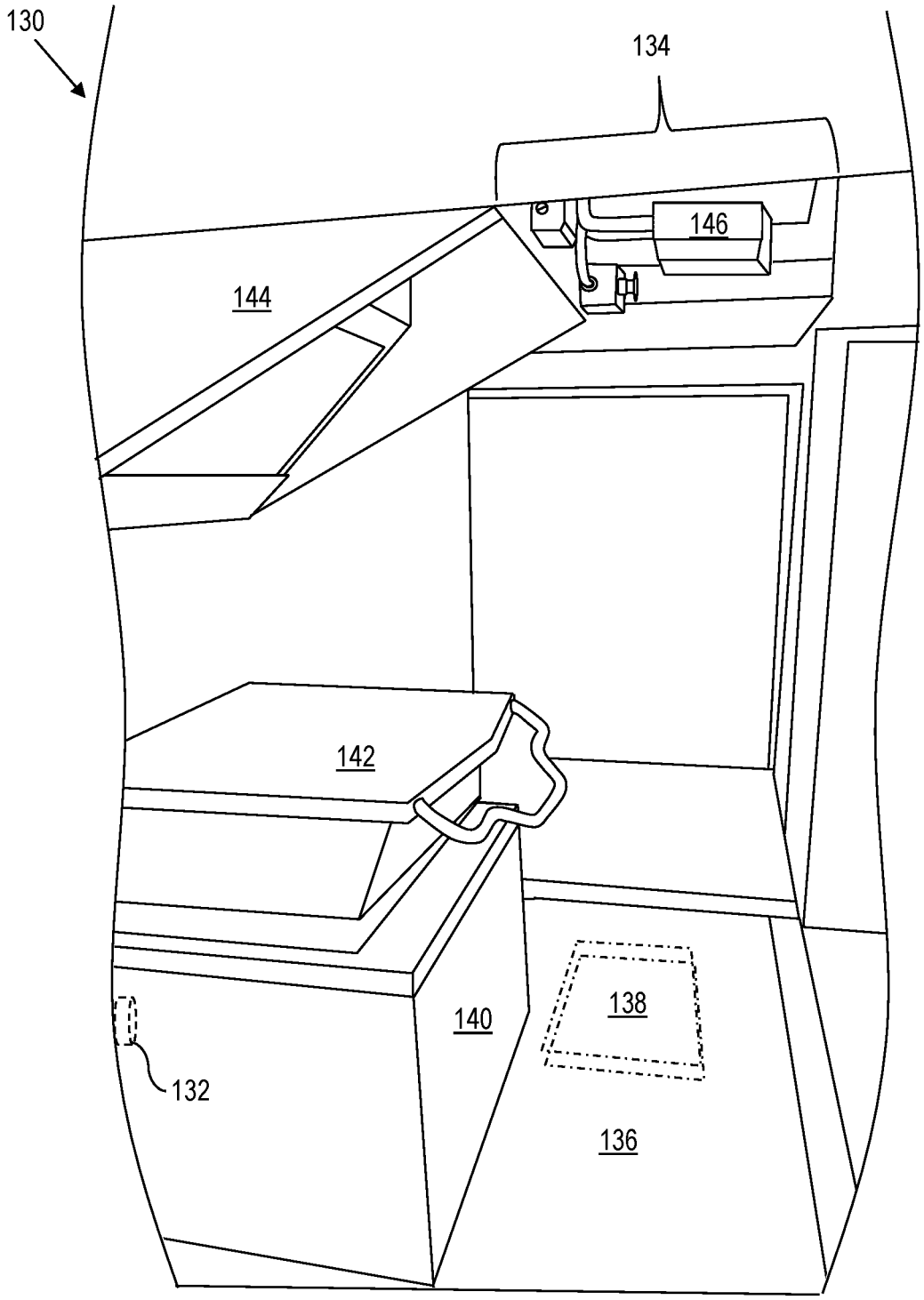
FIG. 3 is a perspective view of an interior of the expandable intermodal according to aspects of the present disclosure.

In multiple embodiments, each vertically adjustable support jack 128 includes a base, a vertically adjusting member (e.g., a scissor member having a horizontal screw that raises or lowers a frame of hinged, rhombus-shaped linkages, etc.), and a guide plate. The guide plate is configured to catch and align the various expansion panels once the expansion panels have been deployed. The raised recess wall of the guide plate, which forms a corner geometry, thus conveniently aligns the corresponding mating panels Now referring to FIG. 3, an embodiment of an interior 130 of the expandable intermodal container is illustrated. For reference, the interior 130 of FIG. 3 is spatially between the expansion units (108*a*-108*c* in FIGS. 2A and 2B). The expandable intermodal container 102 comprises an appliance utility port 132 disposed in the interior 130 of the expandable intermodal container (e.g., behind appliance as described in greater detail herein), a ceiling panel 134 and a floor panel 136.

Configuration of the appliance utility port 132 varies based on configurations within the expandable intermodal container. For example, the appliance utility port 132 can be a gas line (inlet/outlet), water lines (inlet/outlet), a power entry point to power appliances, an exhaust system (e.g., vent), and/or any utility port reasonably necessary to carry out the desired function of the expandable field kitchen 100.

In various embodiments, the expandable intermodal container comprises a recessed grease trap 138 under a portion the floor panel 136. For example, the recessed grease trap 138 can be implemented as a gravity trap that connects to a waste container (e.g., a bladder) or conduit that channels grease and waste away from the expandable intermodal container.

In this regard, the expandable intermodal container can support virtually any appliance so long as the appliance spatially fits within the expandable intermodal container.

Example appliances include, but are not limited to ovens 140 (e.g., toaster ovens, conventional ovens, convection ovens, microwaves, etc.), grills/griddles 142, hood vents 144, and more.

In various embodiments, the ceiling panel 134 is implemented as a recessed ceiling cavity that allows users to install and/or store various components 146. The recessed ceiling cavity provides a dedicated space for components 146, which can be installed and remain in place irrespective of whether the expandable intermodal container is in a deployed or travel configuration. Thus, the components 146 do not need to be uninstalled and re-installed each time the expandable intermodal container is relocated.

Examples of components 146 include environmental controls (e.g., electrical control panels, HVAC components, etc.), appliance controls (e.g., grease filter/fan, exhaust system that channels cooking byproducts from an interior portion of the expandable field kitchen to an exterior portion of the expandable field kitchen, etc.), wiring for appliances or other portions of the expandable intermodal container 102 (e.g., concealed wiring that runs from the electrical control panel to one or more expansion units), etc.

Figure 4:
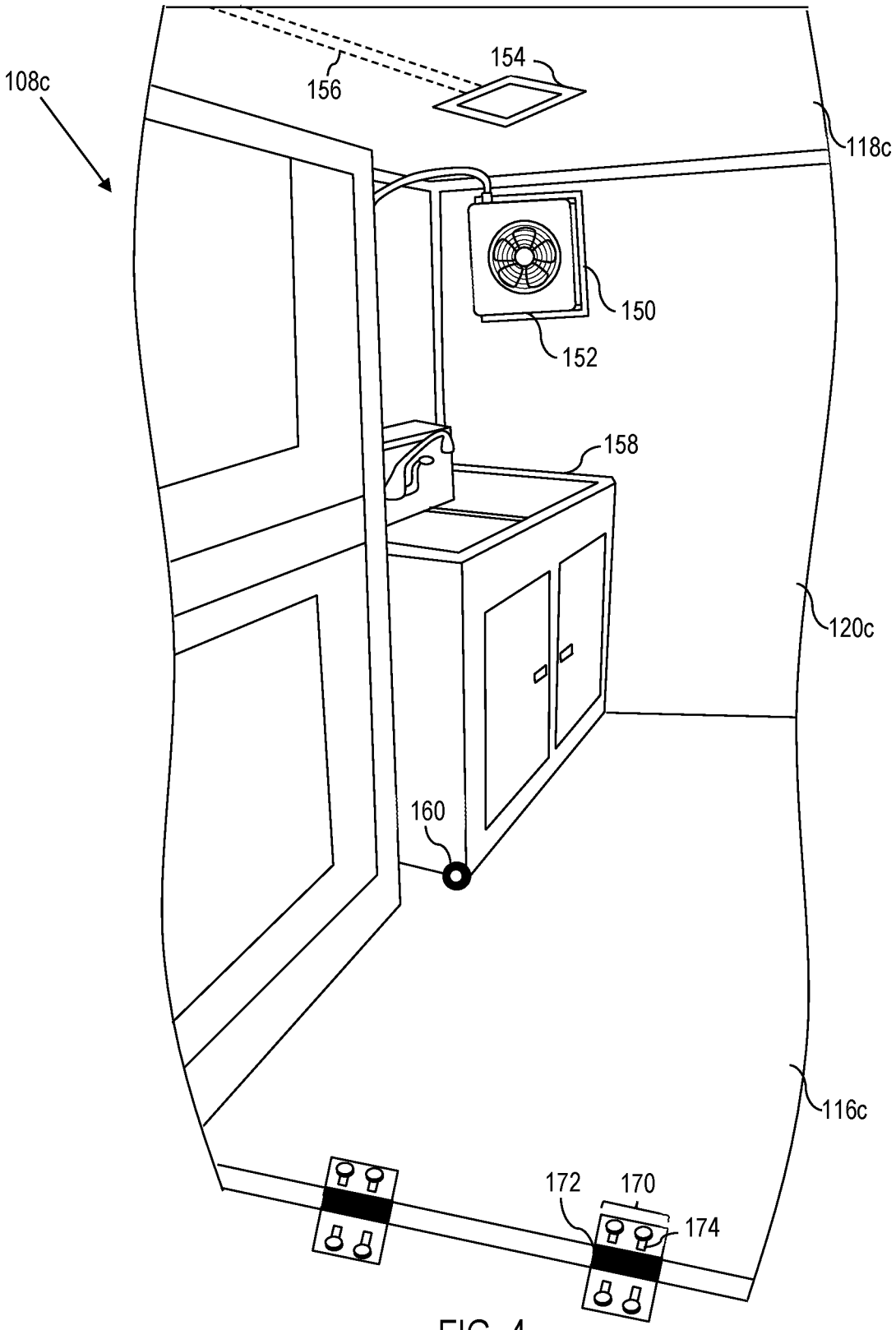
FIG. 4 is a perspective view of an embodiment of an interior of an expansion unit according to aspects of the present disclosure.

FIG. 4 illustrates an example configuration of an interior of the expansion unit 108*c*. Here, the expansion floor panel 116*c*, an expansion ceiling panel 118*c*, and the expansion front panel 120*c* are provided for context.

In various embodiments, the expansion unit 108*c* comprises a heating, ventilation, and air conditioning (HVAC) port 150 that accepts removable HVAC unit 152. In multiple embodiments, a gasketed seal is disposed between the HVAC port 150 and the HVAC unit 152 when installed. Moreover, while the HVAC port 150 and HVAC unit 152 are disposed on the front expansion panel 120*c* in this illustration, they could be on other expansion panels in other configurations.

In addition to (or alternative to the HVAC unit 152), the expansion unit 108*c* may comprise exhaust systems and other mechanisms that correspond to appliances in use within the expansion unit 108*c* (e.g., hood vent for grill or stovetop).

In various embodiments, the expansion unit 108*c* comprises an embedded lighting unit 154 and concealed electrical wiring 156 that couples the embedded lighting unit 154 to an electrical control panel (see., e.g., component 146 in FIG. 3). In various embodiments, the embedded lighting unit 154 includes insulation (e.g., wiring insulation, insulation to shield against weather elements, etc.). Moreover, multiple embedded lighting units may be used (e.g., a first embedded lighting unit in expansion unit 108*c* and a second lighting unit in expansion unit 108*a*).

In further embodiments, the expansion unit 108*c* comprises a detachable sink unit 158. In multiple implementations, the detachable sink unit 158 comprises wheels 160 or other suitable transport mechanisms that allow the detachable sink unit 158 to be stowed in the expandable intermodal container 102 during transport and storage of the expandable field kitchen 100 (e.g., when the expansion unit 108*c* is not deployed).

Also illustrated in FIG. 4 is a floor coupler 170 that fastens the expansion unit 108*c* to the expandable intermodal container (e.g., couples a floor panel to an expansion floor panel). The floor coupler 170 comprises a hinge mechanism 172 with built in channels 174 that receive fasteners (e.g., screws, bolts, etc.), which allows the fasteners that are coupled to the expansion floor panel 116*c* to make slight adjustments to allow for better fitment between expansion unit 108*c* components as described herein. Further, the channels 174 within the floor coupler 170 provide enough "play" to allow the expansion floor panel 116*c* to shift in order to account for unlevel conditions.

Alternative acceptable hinges include bi-fold hinges, butt hinges, case hinges, conceal hinges, continuous hinges, flag hinges, slip joint hinges, overlay hinges, stop hinges, piano hinges, etc.

Figure 5:
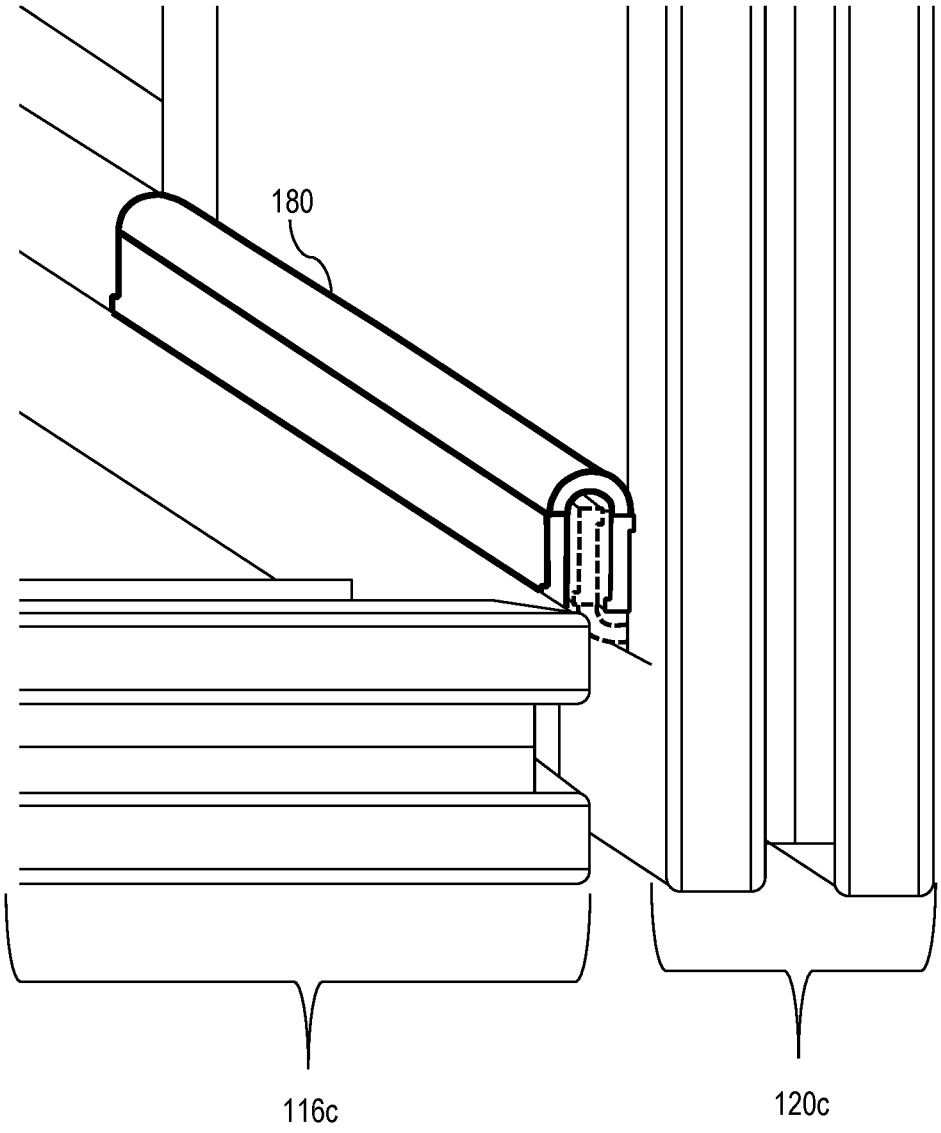
FIG. 5 is a perspective view of a panel coupler for use in an expansion unit according to aspects of the present disclosure.

FIG. 5 illustrates a panel coupler 180 that allows various expansion panels to interconnect. Here, the panel coupler 180 is connecting the expansion floor panel 116*c* to the expansion front panel 120*c*. Here, the expansion floor panel 116*c* and the expansion front panel 120*c* are shown in a sandwich panel configuration.

In preferred embodiments, the panel coupler 180 is comprised of two separate parts (e.g., J-hooks) that link together. Here, one part is coupled to the expansion floor panel 116*c*, while the other part is coupled to the expansion front panel 120*c*. Specifically, the J-hooks uniformly attach the floor to the walls strengthening and reinforcing the floor and uniformly distributing the floor load to the walls which support the floor. Each part is highlighted by different line weights and dashes for clarity. In this regard, other geometries could be used to achieve the same or similar function.

Figure 6:
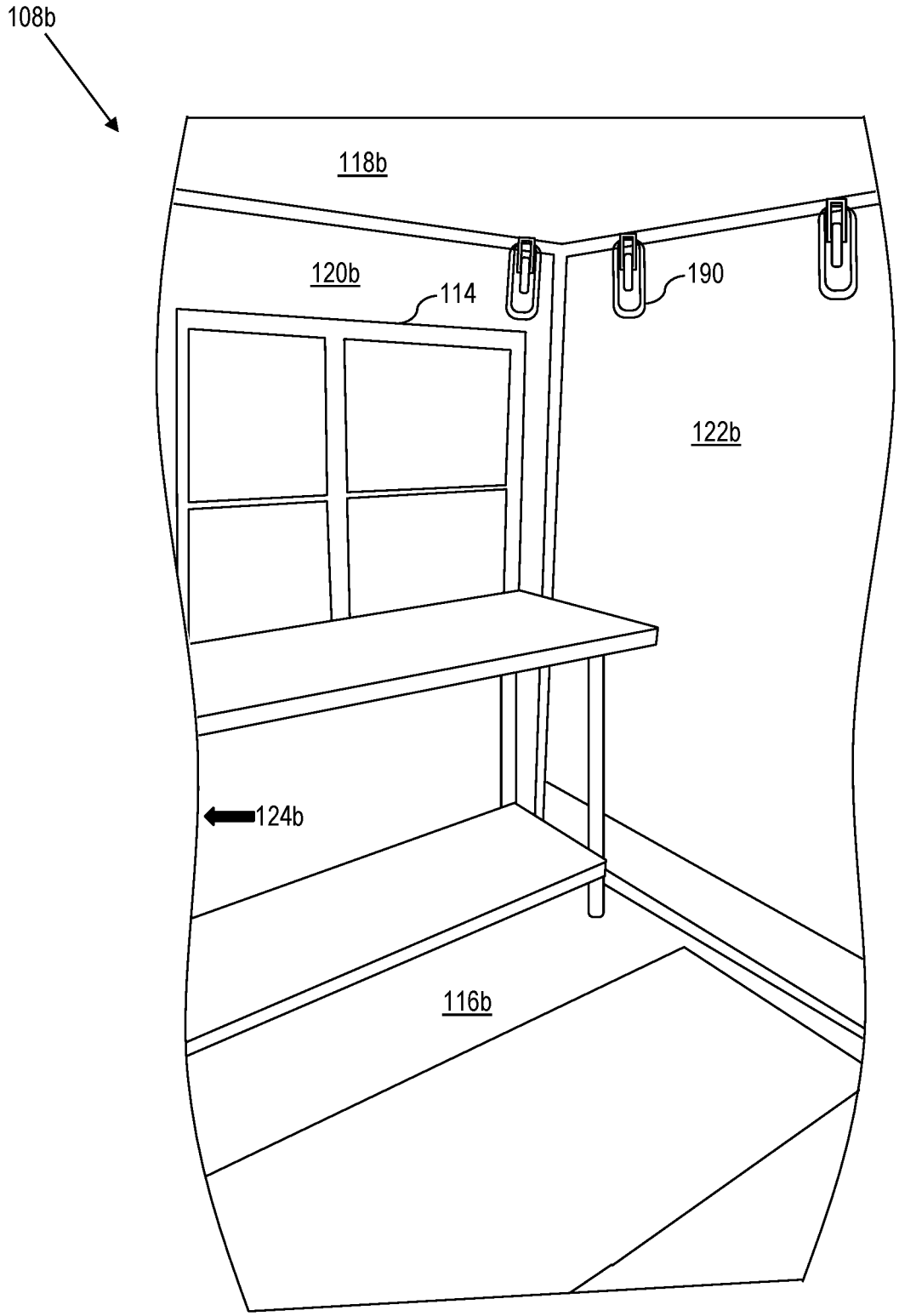
FIG. 6 is a perspective view of another embodiment of an interior of an expansion unit according to aspects of the present disclosure.

Now referring to FIG. 6, which illustrates an example configuration of an interior of the expansion unit 108*b*, which includes the expansion floor panel 116*b*, the expansion ceiling panel 118*b*, the expansion front panel 120*b*, the first expansion side panel 122*b*, the second expansion side panel 124*b* (out of view, but indicated by directional arrow), and the serving window 114 disposed on the expansion front panel 120*b*. The serving window 114 allows users to pass food or other items from inside the expansion unit 108*b* to outside of the expansion unit 108*b* without physically exiting the expansion unit 108*b*.

Also illustrated in FIG. 6 are panel-to-panel fasteners 190. Suitable fasteners include latches, cam locks, lever locks, deadbolts, pad locks, recess locks (e.g., recessed catch point), mortise locks, etc. While many different types of fasteners can be used, preferred embodiments include over-center latches and J-hooks.

In practice, multiple types of fasteners may be used on one or more panels. For example, J-hooks (see e.g., FIG. 5) can be used to support floor panels (e.g., where an expansion floor panel engages an expansion front panel or expansion side panels), while the over center latches can be used to engage gaskets between various panels (e.g., between the expansion ceiling panel and expansion front panel) for a tighter fit between panels.

Figure 7:
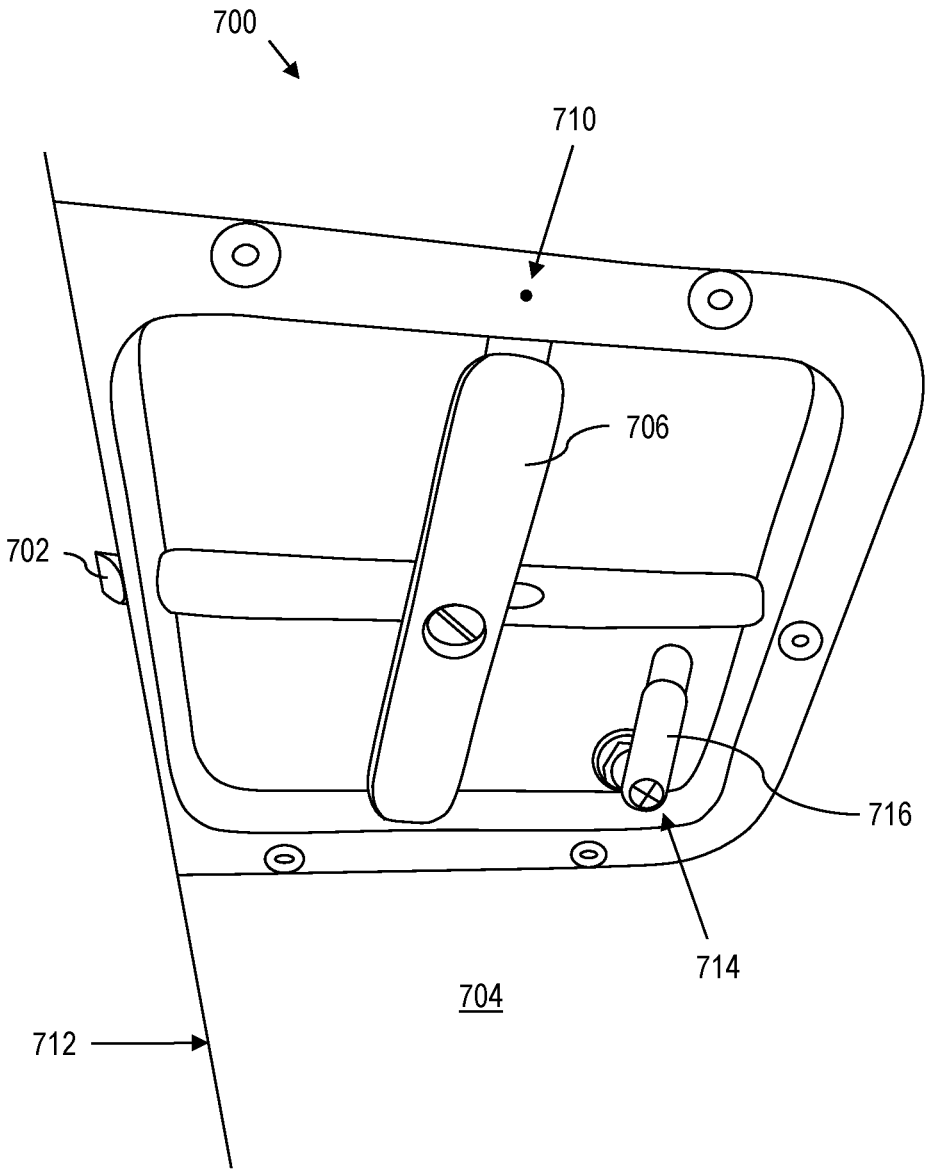
FIG. 7 is an illustration of a low-profile door handle in an unlocked position, according to aspects of the present disclosure.
Figure 8:
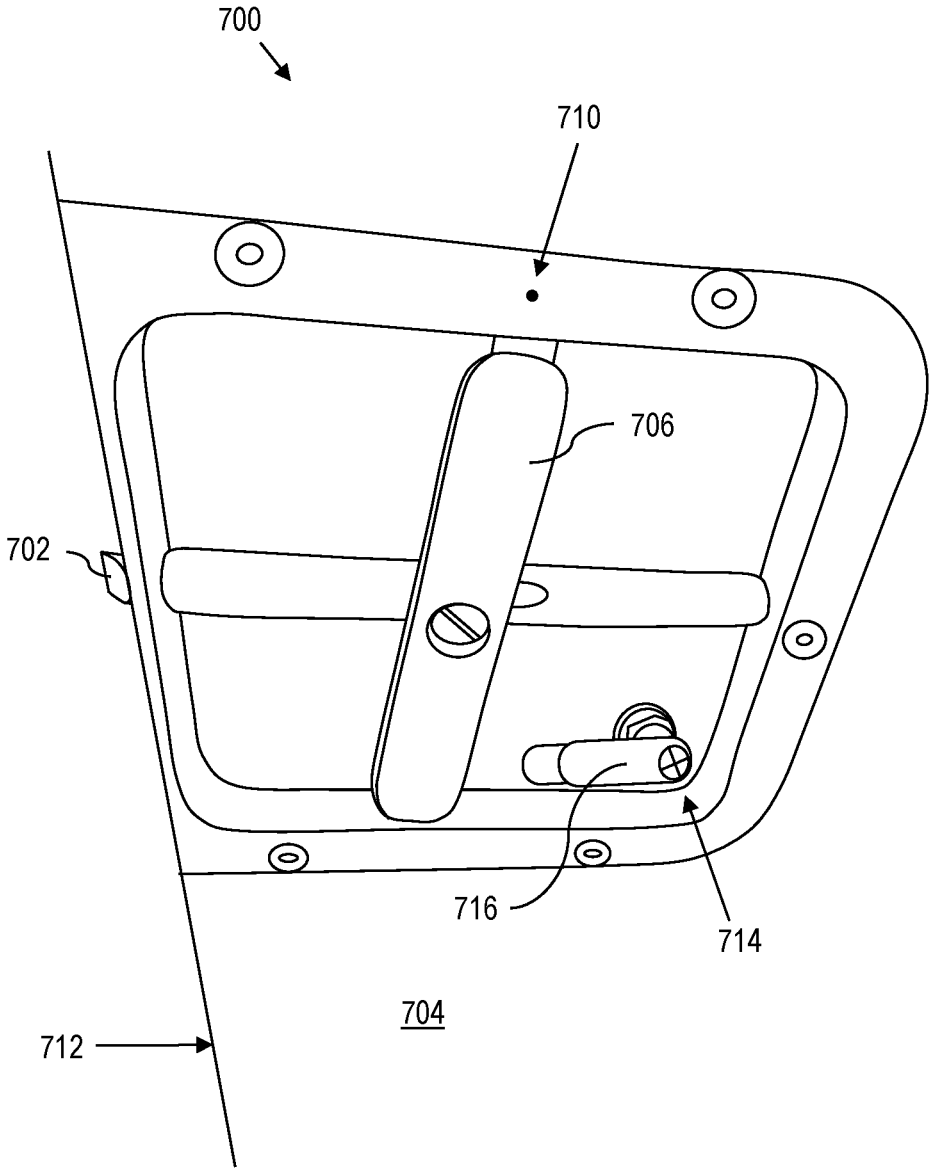
FIG. 8 is an illustration of a low-profile door handle in a locked position, according to aspects of the present disclosure.

FIGS. 7-8 illustrate an embodiment of a low-profile door handle 700 to be used in the thinner doors of embodiments of expandable containers described herein. FIG. 7 illustrates the embodiment of the low-profile door handle 700 in an unlocked position. The low-profile door handle 700 includes a latch 702 that prevents a door 704 in which the low-profile door handle 700 is installed from opening when the latch 702 is engaged. Further, the low-profile door handle 700 includes a lever 706 coupled to a pivot point 710 and coupled to the latch 702. When a user applies force to the lever 706 in a direction away from an edge 712 of the door 704, the lever 706 also pulls the latch 702 into a recess 716 of the door handle 700 to allow the door 704 to open. In some embodiments, the lever 706 is biased such that when no force is applied to the lever 706, the lever 706 returns to the position shown in FIG. 7. In other embodiments, the user must apply force to return the lever 706 and latch 702 to the position of FIG. 7. Moreover, some embodiments of the low-profile door handle 700 include a locking mechanism 714, and as shown in FIG. 7, the low-profile door handle 700 is in an unlocked state. However, in FIG. 8, the locking mechanism 714 has been rotated such that a stop 716 of the low-profile door handle 700 prevents the lever 706 from traversing enough to allow the latch 702 to clear a door jamb (and strike plate); thus preventing the door from opening. The low-profile door handle 700 looks similar on both sides of the door, except that one side may also include a slot for a key to turn the locking mechanism.

If door is 3-4 inches (7-10 centimeters) thick, a traditional handle can be easily countersunk. However, as the door gets thinner (e.g., 2.5 centimeters), it gets harder to provide enough space for a user to grab and move the handle. Traditional door handles will not work with such a thin door without the handle sticking out. However, the low-profile door handle disclosed herein can be used in such thin doors. The lever of the low-profile door handle rotates such that it slides to open the door and there is no need for a large gap behind the lever.

Miscellaneous

While aspects of the present disclosure have been directed toward expandable field-kitchens, it is possible to substitute different appliances and equipment to render the expandable containers herein suitable for other applications. Such applications include adapting a container to function as a latrine, laundry, shower, living module, office or workshop. For example, the grease trap disclosed in various embodiments of the present disclosure could be repurposed or modified to as a plumbing for a toilet if the expandable container is repurposed to be a latrine, living quarters, laundry, and/or shower.

In another example of adapting the various containers to function as facilities such as a latrine or shower, a raised "false floor" that can be implemented such that plumbing and drain features would be contained inside the raised false floor, and by extension within the container, but be hidden from the users. In various implementations, the raised false floor is a second floor panel that is on top of a floor panel, wherein the raised false floor has an internal volume.

By way of example, an expandable intermodal container comprising a ceiling panel, a floor panel, and an appliance utility port, is being used as a latrine. Disposed above the floor panel is a raised false floor having an internal volume that can be used to house plumbing, waste, etc. Moreover, the raised false floor may further comprise an outlet to dump waste, purge contents of the false floor, etc.

Multiple types of power sources can be utilized to power the expandable field kitchens described herein. Suitable power sources include a electrical grid (e.g., microgrid), a battery, local power (e.g., a generator or an electrical cable that is connected to a local power grid), short power, a solar powered mechanism, and a wind powered mechanism.

Moreover, various embodiments of the expandable field kitchen may further comprise a spatial partition between the expandable intermodal container and an expansion unit. The spatial partition allows users to create two distinct zones wherein each zone can be adjusted to different thermal temperatures or prevent cross contamination of food items. In an example embodiment, the expandable intermodal container can be used to prepare food, while the expansion unit may be configured as a temporary refrigerator or freezer.

The spatial partition may be structurally configured in a variety of ways such as a bulkhead, an insulated material (e.g., insulated wall), an articulating panel, combinations thereof, etc.

The figures associated with respect to the expandable field kitchen illustrate a sampling of the various possible embodiments. Different combinations of the present disclosure herein can yield alternate embodiments. For example, while the above implementation had two expansion units, three or more expansion units may be used. In addition, additional serving windows and access doors (e.g., a second access door) can be implemented as needed.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. Aspects of the disclosure were chosen and described to best explain the principles of the disclosure and the practical application, and to enable others of ordinary skill in the art to understand the disclosure for various embodiments with various modifications as are suited to the particular use contemplated. Therefore, some aspects of the present disclosure can be executed in an order other than indicated herein.

What is claimed is:

1. An expandable field kitchen comprising:
- an expandable intermodal container comprising;
  - an appliance utility port disposed on an interior surface of the expandable intermodal container;
  - a ceiling panel;
  - a floor panel; and
  - a wall panel formed by a door to provide an opening;
- an access door disposed on the wall panel within the opening;
- an expansion unit that deploys from an interior portion of the expandable intermodal container through the opening; and
- a service door having a low-profile door handle, wherein the low-profile door handle includes:
- a latch that prevents the service door from opening when the latch is engaged; and
- a lever coupled to a pivot point and the latch such that when a user applies force to the lever in a direction away from an edge of the service door, the lever also pulls the latch into a recess of the door handle to allow the service door to open.

2. The expandable field kitchen of claim 1, wherein:
the expansion unit comprises:
an expansion floor panel;
an expansion ceiling panel that opposes the expansion floor panel;
an expansion front panel that couples to the expansion floor panel and the expansion ceiling panel;
a first expansion side panel disposed orthogonally to the expansion floor panel and the expansion ceiling panel; and
a second expansion side panel that opposed the first expansion side panel.

3. The expandable field kitchen of claim 2, wherein:
the first expansion side panel, the second expansion side panel, the expansion front panel, or a combination thereof couple to the expansion floor panel via a J-hook coupler.

4. The expandable field kitchen of claim 3 further comprising:
an electrical control panel disposed on a surface of the ceiling panel of the expandable intermodal container; and
wherein the expansion ceiling panel comprises:
an embedded lighting unit; and
surface mounted wiring that couples to the embedded lighting unit to the electrical control panel.

5. The expandable field kitchen of claim 2 further comprising:
a serving window disposed on the expansion front panel, the first expansion side panel, the second expansion side panel, or a combination thereof.

6. The expandable field kitchen of claim 2, wherein:
the expansion unit further comprises:
a heating, ventilation, and air conditioning port that accepts removable heating, ventilation, and air conditioning unit; and
a gasketed seal disposed between the heating, ventilation, and air conditioning port and the heating, ventilation, and air conditioning unit when installed.

7. The expandable field kitchen of claim 2, wherein:
the expansion floor panel, the expansion ceiling panel, the expansion front panel, the first expansion side panel, the second expansion side panel, or a combination thereof comprise vacuum insulated panels.

8. The expandable field kitchen of claim 1 further comprising:
a detachable sink unit that stows in the expandable intermodal container when the expansion unit is undeployed.

9. The expandable field kitchen of claim 1 further comprising:
an exhaust system that channels cooking byproducts from an interior portion of the expandable field kitchen to an exterior portion of the expandable field kitchen.

10. The expandable field kitchen of claim 1, wherein:
the access door is an outward-articulating double-door.

11. The expandable field kitchen of claim 1 further comprising:
a recessed grease trap under a portion the floor panel.

12. An expandable field kitchen comprising:
an expandable intermodal container comprising:
an appliance utility port disposed on an interior surface of the expandable intermodal container;
a recessed ceiling cavity;
an electrical control panel disposed in the recessed ceiling cavity;
a floor panel comprising a recessed grease trap under a portion the floor panel; and
a wall panel formed by a door to provide an opening;
an access door disposed on the wall panel; and
an expansion unit that deploys from the expandable intermodal container through the opening, wherein the expansion unit comprises:
an expansion floor panel;
an expansion ceiling panel that opposes the expansion floor panel;
an expansion front panel that couples to the expansion floor panel and the expansion ceiling panel;
a first expansion side panel disposed orthogonally to the expansion floor panel and the expansion ceiling panel; and
a second expansion side panel that opposed the first expansion side panel; and
a service door having a low-profile door handle, wherein the low-profile door handle includes:
a latch that prevents the service door from opening when the latch is engaged; and
a lever coupled to a pivot point and the latch such that when a user applies force to the lever in a direction away from an edge of the service door, the lever also pulls the latch into a recess of the door handle to allow the service door to open.

13. The expandable field kitchen of claim 12 further comprising:
a second access door that opposes the first access door; and
a second expansion unit that deploys from the expandable intermodal container through a second opening created by opening the second access door, wherein the second expansion unit comprises:
a second expansion floor panel;
a second expansion ceiling panel that opposes the second expansion floor panel;
a second expansion front panel that couples to the second expansion floor panel and the second expansion ceiling panel;
a third expansion side panel disposed orthogonally to the second expansion floor panel and the second expansion ceiling panel;
a fourth expansion side panel that opposes the third expansion side panel; and
a second service door having a low-profile door handle disposed on the third expansion side panel, the fourth expansion side panel, the second expansion front panel, or a combination thereof.

14. The expandable field kitchen of claim 13, wherein:
the expansion ceiling panel comprises:
a first embedded lighting unit; and
concealed electrical wiring that couples to the first embedded lighting unit to the electrical control panel; and
the second expansion ceiling panel comprises:
a second embedded lighting unit; and
concealed electrical wiring that couples to the second embedded lighting unit to the electrical control panel.

15. The expandable field kitchen of claim 12, wherein:
the expansion ceiling panel extends beyond the expansion front panel.

16. The expandable field kitchen of claim 12, wherein:
the service door is disposed on the expansion unit.

17. The expandable field kitchen of claim 12, wherein:
the service door is disposed on the expandable intermodal container.

18. An expandable field kitchen comprising:
an expandable intermodal container comprising:
an appliance utility port disposed on an interior surface of the expandable intermodal container;
a recessed ceiling cavity;
an electrical control panel disposed in the recessed ceiling cavity; and
a floor panel comprising a recessed grease trap under a portion the floor panel;
a first access door that provides access to an interior portion the expandable intermodal container;
a first expansion unit that deploys from the expandable intermodal container through an opening created by opening the first access door, wherein the first expansion unit comprises:
an expansion floor panel;
an expansion ceiling panel that opposes the expansion floor panel;
an expansion front panel that couples to the expansion floor panel and the expansion ceiling panel;
a first expansion side panel disposed orthogonally to the expansion floor panel and the expansion ceiling panel;
a second expansion side panel that opposed the first expansion side panel; and
a service door having a low-profile door handle disposed on the first expansion side panel, the second expansion side panel, the expansion front panel, or a combination thereof, wherein the low-profile door handle includes:
a latch that prevents the service door from opening when the latch is engaged; and
a lever coupled to a pivot point and the latch such that when a user applies force to the lever in a direction away from an edge of the service door, the lever also pulls the latch into a recess of the door handle to allow the service door to open;
a second access door that opposes the first access door;
a second expansion unit that deploys from the expandable intermodal container through a second opening created by opening the second access door, wherein the second expansion unit comprises:
a second expansion floor panel;
a second expansion ceiling panel that opposes the second expansion floor panel;
a second expansion front panel that couples to the second expansion floor panel and the second expansion ceiling panel;
a third expansion side panel disposed orthogonally to the second expansion floor panel and the second expansion ceiling panel;
a fourth expansion side panel that opposes the third expansion side panel; and
a second service door having a low-profile door handle disposed on the third expansion side panel, the fourth expansion side panel, the second expansion front panel, or a combination thereof; and
a third access door that is adjacent to the first access door and the second access door;
a third expansion unit that deploys from the expandable intermodal container through a third opening created by opening the third access door, wherein the third expansion unit comprises:
a third expansion floor panel;
a third expansion ceiling panel that opposes the third expansion floor panel;
a third expansion front panel that couples to the third expansion floor panel and the third expansion ceiling panel;
a fifth expansion side panel disposed orthogonally to the third expansion floor panel and the third expansion ceiling panel;
a sixth expansion side panel that opposes the fifth expansion side panel; and
a service window disposed on the fifth expansion side panel, the sixth expansion side panel, the third expansion front panel, or a combination thereof.

19. The expandable field kitchen of claim 18 further comprising:
a power source that supplies energy to the expandable field kitchen comprising a generator, power conduit from an electrical grid, a microgrid, a battery, a solar powered mechanism, a wind powered mechanism, or a combination thereof.

20. The expandable field kitchen of claim 18 further comprising:
floor couplers that couple the floor panel of the expandable intermodal container to the first expansion floor panel, the second expansion floor panel, or the third expansion floor panel, wherein the floor coupler comprises a hinge mechanism with built in channels that receive fasteners.

* * * * *